US005975914A

United States Patent [19]

Uchida

[11] Patent Number: 5,975,914

[45] Date of Patent: Nov. 2, 1999

[54] ELECTRICAL CONNECTOR AND METHOD FOR MANUFACTURING THE SAME

[75] Inventor: Masaki Uchida, Tokorozawa, Japan

[73] Assignee: The Whitaker Corporation, Wilmington, Del.

[21] Appl. No.: 09/043,437

[22] PCT Filed: Sep. 19, 1996

[86] PCT No.: PCT/US96/15004

§ 371 Date: Mar. 17, 1998

§ 102(e) Date: Mar. 17, 1998

[87] PCT Pub. No.: WO97/11514

PCT Pub. Date: Mar. 27, 1997

[30] Foreign Application Priority Data

Sep. 19, 1995 [JP] Japan ..... 7-240187

[51] Int. Cl.[6] ..... H01R 9/09

[52] U.S. Cl. ..... 439/66; 439/74; 439/733.1

[58] Field of Search ..... 439/74, 44, 66, 439/733.1

[56] References Cited

U.S. PATENT DOCUMENTS

| | | | |
|---|---|---|---|
| 3,173,732 | 3/1965 | James | 439/74 |
| 3,551,750 | 12/1970 | Sterling | 439/66 |
| 3,960,424 | 6/1976 | Weisenburger | 339/17 M |
| 4,161,346 | 7/1979 | Cherian et al. | 339/17 M |
| 4,623,207 | 11/1986 | Sasaki et al. | 439/66 |
| 4,664,458 | 5/1987 | Worth | 439/74 |
| 4,688,864 | 8/1987 | Sorel | 439/74 |
| 4,699,593 | 10/1987 | Grabbe et al. | 439/71 |
| 5,160,268 | 11/1992 | Hakamian | 439/66 |
| 5,358,411 | 10/1994 | Mroczkowski et al. | 439/66 |
| 5,380,210 | 1/1995 | Grabbe et al. | 439/66 |
| 5,484,295 | 1/1996 | Mowry et al. | 439/66 |
| 5,498,166 | 3/1996 | Rothenberger | 439/66 |

FOREIGN PATENT DOCUMENTS

| | | | |
|---|---|---|---|
| OS 1490440 | 11/1969 | Germany . | |
| OS 2234961 | 4/1973 | Germany | H05K 1/08 |

*Primary Examiner*—Steven L. Stephan
*Assistant Examiner*—Hae Moon Hyeon
*Attorney, Agent, or Firm*—Anton P. Ness

[57] ABSTRACT

An electrical connector including an insulating housing (20) having surfaces (22,24) for facing mutually facing circuit boards, electrical contacts (50,52) disposed in contact press-fitting holes (26,28) in the insulating housing (20) with central sections of the contacts secured within the insulating housing (20). Contact sections of the electrical contacts (50,52) extend outwardly from the surfaces (22,24) of the insulating housing (20) and are bent to extend along the respective board-facing surfaces (22,24) and spaced therefrom defining spring contact members (54,58) for electrical engagement with conductive pads on the circuit boards.

20 Claims, 5 Drawing Sheets

ELECTRICAL CONNECTOR AND METHOD FOR MANUFACTURING THE SAME

FIELD OF THE INVENTION

The present invention relates to an electrical connector for disposition between mutually facing circuit boards so that the circuit boards are electrically connected to each other.

BACKGROUND OF THE INVENTION

Electrical connectors which electrically connect mutually facing circuit boards have been widely used in the past. An electrical connector of this type is disclosed in Japanese Patent Publication No. 55-37787 in which through-holes are formed inside an insulating housing, and contacts which are bent in a multiple number of places in order to endow the contacts with spring properties, are passed through the through-holes in the insulating housing and fastened in place. Another connector of this type is disclosed in Japanese Patent Publication No. 63-43279 in which contact retaining ribs are formed inside an insulating housing, and contacts with spring properties are retained therein by these ribs.

The contacts used in the conventional electrical connectors described above are formed by punching metal plates into predetermined shapes prior to the installation of the contacts in the insulating housing. These contacts have complicated shapes in order to endow the contacts with spring properties; accordingly, the work involved in manufacturing the contacts and the work required in order to install the manufactured contacts within the insulating housing are also complicated. As a result, the manufacturing process used to manufacture such electrical connectors is relatively complicated. Furthermore, in the manufacture of the contacts, the portions of the punched metal plates that do not form portions of the contacts are discarded. As a result, the utilization of materials is inefficient, and a corresponding increase in the cost takes place. In addition, the positions of engagement between the contacts and the circuit boards may be skewed, so that the orientation of the electrical connector mounted on the circuit boards is not correct, thus leading to the electrical connector providing improper connections between the contacts and the conductive pads on the circuit boards.

SUMMARY OF THE INVENTION

The present invention was devised to overcome the above drawbacks. One feature of the present invention is to provide an electrical connector which utilizes contact materials in an efficient manner, and which maintains a stable attitude when mounted on circuit boards. Furthermore, another feature of the present invention is to provide a method for manufacturing an electrical connector in which the manufacturing process is simpler than in conventional methods The electrical connector of the present invention is to be disposed between mutually facing circuit boards so that the circuit boards are electrically connected to each other, the electrical connector comprises an insulating housing which has two surfaces that face the respective circuit boards, and in which a plurality of contact press-fitting holes that pass through the two surfaces are formed in a row; and a plurality of plate contacts, each including a central section that is press-fit into one of the contact press-fitting holes, and two contact sections that extend from the central section and springably engage the respective circuit boards, the contacts being aligned in a row in the insulating housing.

Furthermore, the method of the present invention for manufacturing the electrical connector of the present invention which is to be disposed between mutually facing circuit boards so that the circuit boards are electrically connected to each other, comprises molding an insulating housing having surfaces for facing respective circuit boards and a row of contact press-fitting holes that extend through the surfaces; forming linear contacts each of which includes a central section and contact sections extending outwardly from the central section; inserting the linear contacts into the contact press-fitting holes so that the central sections are press-fitted within a press-fitting section of the insulating housing and the contact sections extend outwardly from the surfaces of the insulating housing; and bending the contact sections so that they extend along the surfaces of the insulating housing as spring contact members for springable engagement with the circuit boards to electrically connect the circuit boards together.

An embodiment of the invention will now be disclosed by way of example with reference to the accompanying drawings in which

BRIEF DESCRIPTION OF THE DRAWINGS

FIG. 9 is an end view of FIG. 7;

DETAILED DESCRIPTION

Figure 1:
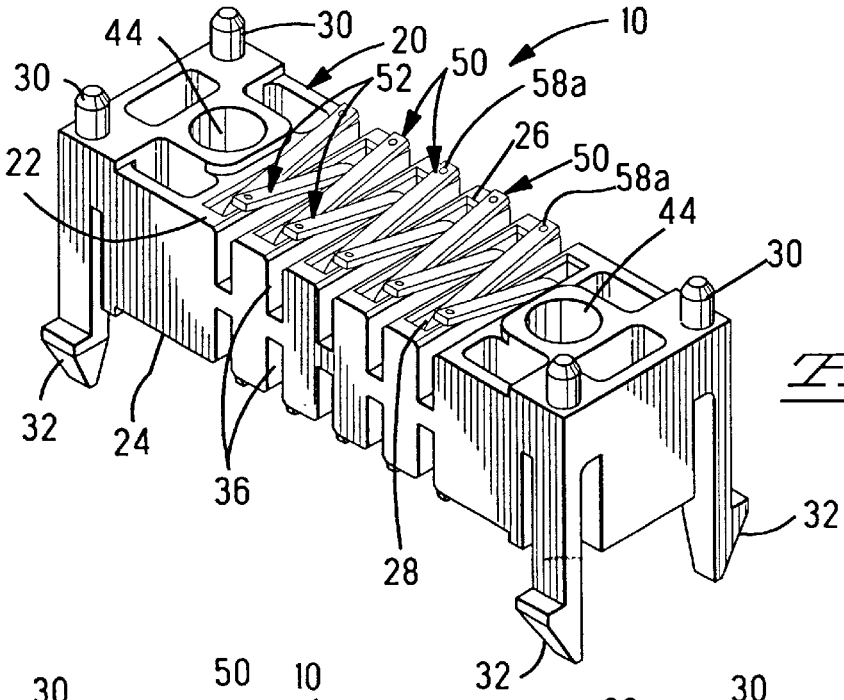
FIG. 1 is an isometric view of an electrical connector of the present invention.
Figure 2:
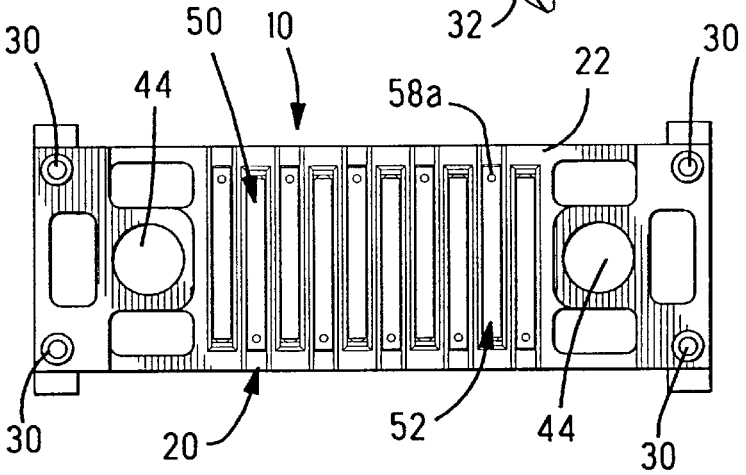
FIG. 2 is a top plan view of FIG. 1.

Electrical connector 10 of the present invention comprises an insulating housing 20 which has an upper surface 22 and a lower surface 24 that face circuit boards (not shown), and a plurality of electrical contacts 50 and 52 which are installed in rows in the insulating housing 20.

Figure 3:
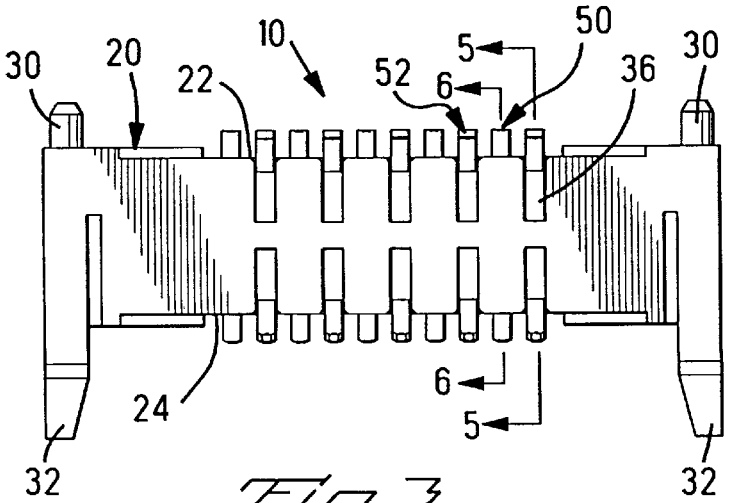
FIGS. 3 and 4 are side elevational and end views respectively of FIG. 2.
Figure 4:
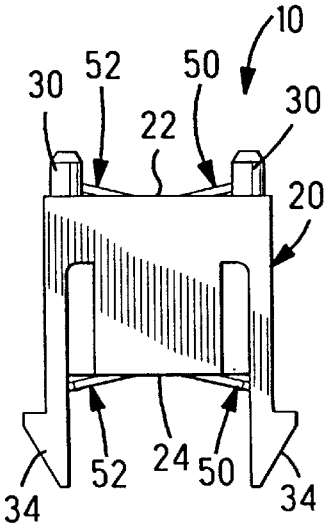
Figure 6:
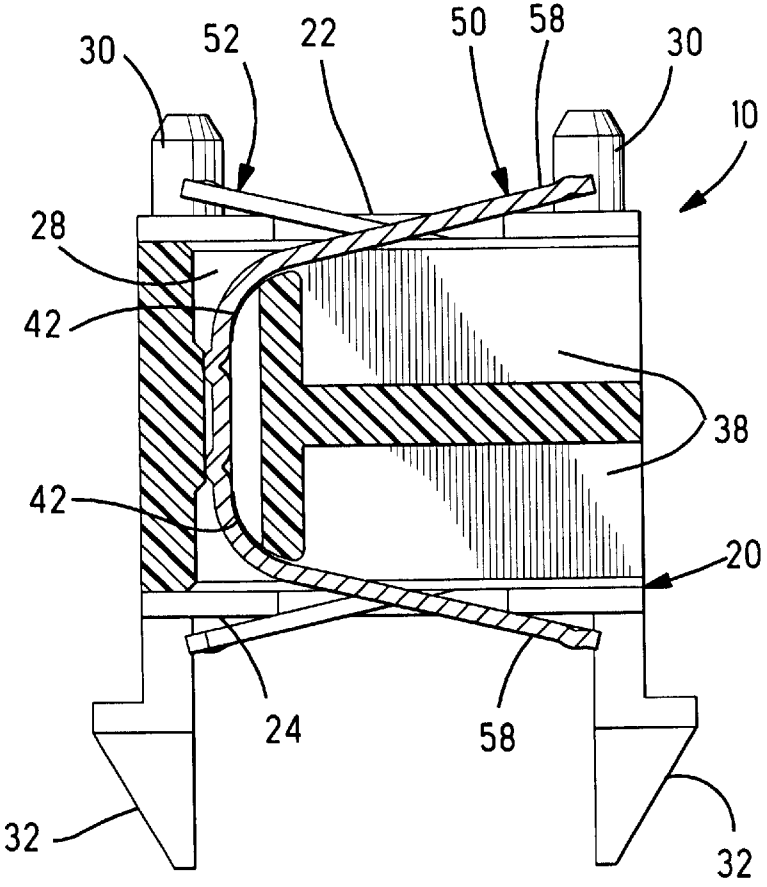
FIGS. 5 and 6 are cross-sectional views taken along lines 5—5 and 6—6 respectively of FIG. 3.
Figure 5:
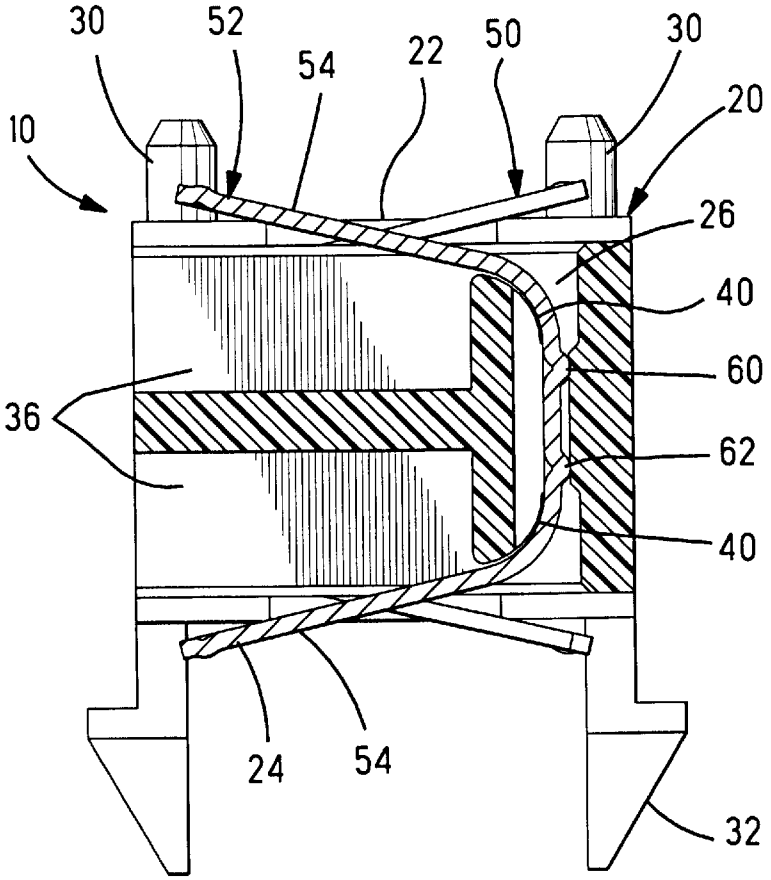

Contact press-fitting holes 26 and 28 which pass through the upper surface 22 and lower surface 24 are formed in respective single rows in the insulating housing 20 along respective sides thereof, so that the contact press-fitting holes 26 and 28 form a desired pattern as seen in an overall view. Contacts 52 are press-fitted in the contact press-fitting holes 26, and contacts 50 are press-fitted in the contact press-fitting holes 28. The central sections of the respective contacts 50 and 52 are secured in the contact press-fitting holes 28 and 26. Furthermore, cavities 36 and 38, which communicate with the respective contact press-fitting holes 26 and 28, are formed in the insulating housing 20. These cavities 36 and 38 are provided in order to insure a sufficient bending space for the bending of both end sections of the contacts 50, 52 projecting linearly from the contact press-fitting holes 26 and 28 as described later. When both end sections of the contacts 50, 52 are subjected to bending in order to form spring contact members 54 and 58, the end sections are bent as far as the interiors of the cavities 36 and 38, so that compensation is made for the return of the end sections due to "spring-back". Engaging members 40 and 42, which act as bending fulcra for the bending of the end sections of the contacts 50, 52, are formed in the boundary areas between the contact press-fitting holes 26 and 28 and the cavities 36 and 38. As shown in FIG. 3, these engaging members 40 and 42 also provide support when the contact sections 54 and 58 engage the circuit boards and bend.

Furthermore, positioning bosses 30, which are used to position the electrical connector 10 on one of the circuit boards, are formed at the four corners of the upper surface 22 of the insulating housing 20. Moreover, flexible fastening legs 32, which are used for the temporary fastening of the electrical connector 10 to the other circuit board, are formed at the four corners of the lower surface 24. The heights of the bosses 30 and legs 32 are higher than the heights of the contact members 54 and 58 extending along the upper and lower surfaces 22 and 24 of the insulating housing 20. Accordingly, the bosses 30 and legs 32 also act to protect the contact members 54 and 58. Furthermore, it would also be possible to form positioning bosses similar to the positioning bosses 30 instead of the legs 32. Moreover, through-holes 44 used for bolt fastening are formed through the upper surface 22 and lower surface 24, and bolts (not shown) are passed through these through-holes 44 thereby bolt fastening the electrical connector 10 to the circuit boards.

Next, the contacts and the interior shapes of the contact press-fitting holes will be described.

Figure 13:
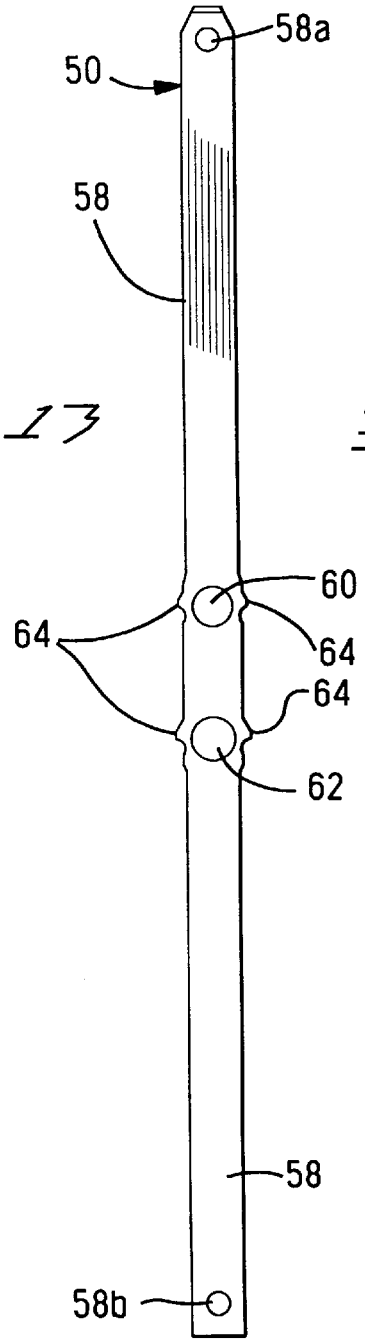
FIG. 13 is a top plan view of an electrical contact for insertion into a contact press-fitting hole of the insulating housing.
Figure 14:
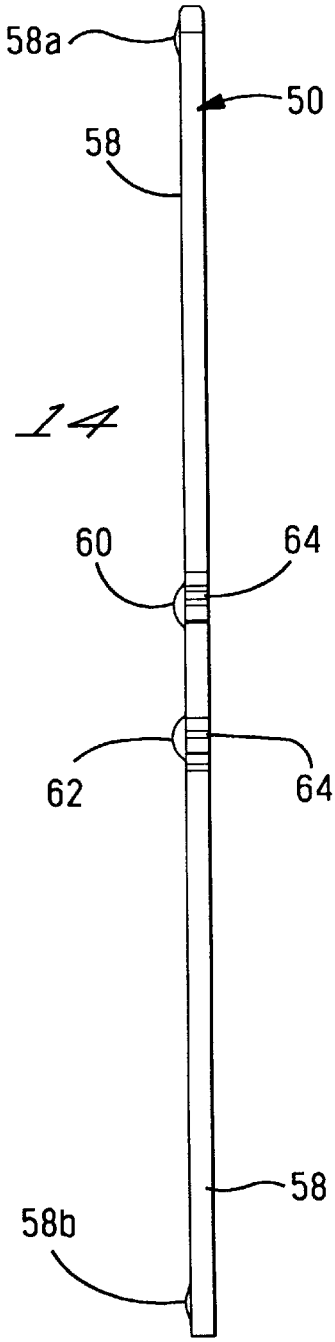
FIG. 14 is a side view of FIG. 13.

The contacts 50 and 52 have the same shape; accordingly, only contacts 50 will be described. As shown in FIGS. 13 and 14, the shape of the contacts 50 at the time of press-fitting in the contact press-fitting holes 26 is linear. Contacts with the shape described above can be manufactured by bending both end sections of these linear contacts. These linear contacts can be manufactured by punching the contacts out of a metal plate. Accordingly, since the waste portions of the metal plate are reduced in size, the utilization of material is very efficient.

Figure 10:
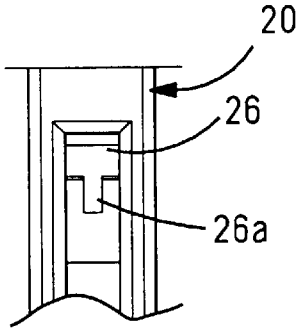
FIG. 10 is an enlarged view of one of a contact press-fitting holes in the insulating housing.
Figure 9:
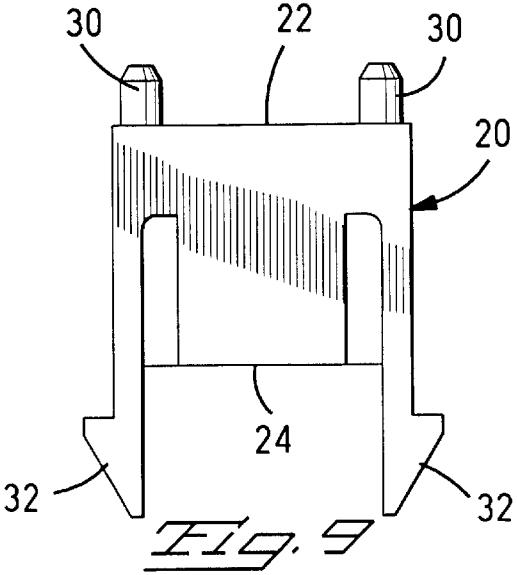
FIGS. 8 and 9 are side elevational and end views respectively of FIG. 7.
Figure 7:
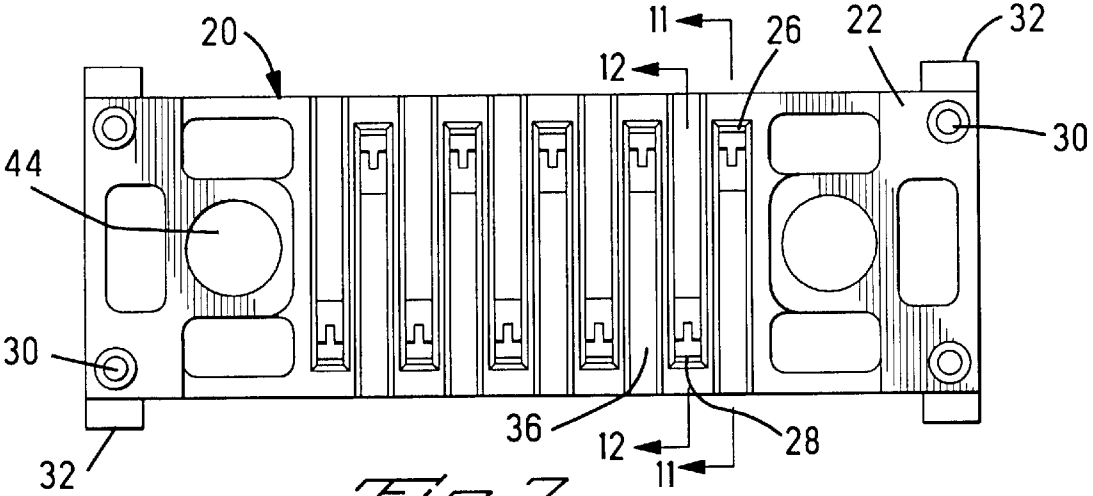
FIG. 7 is a top plan view of the insulating housing of the electrical connector shown in FIG. 1.
Figure 8:
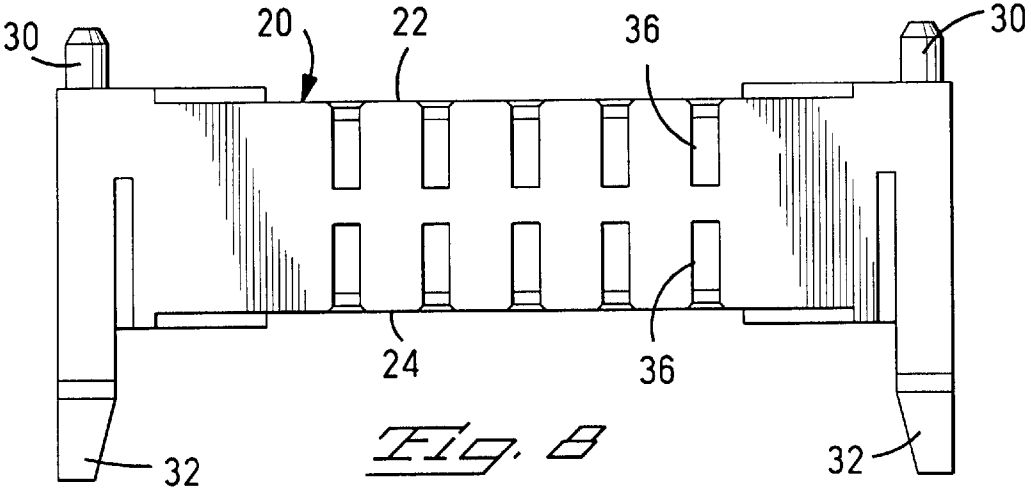
Figure 12:
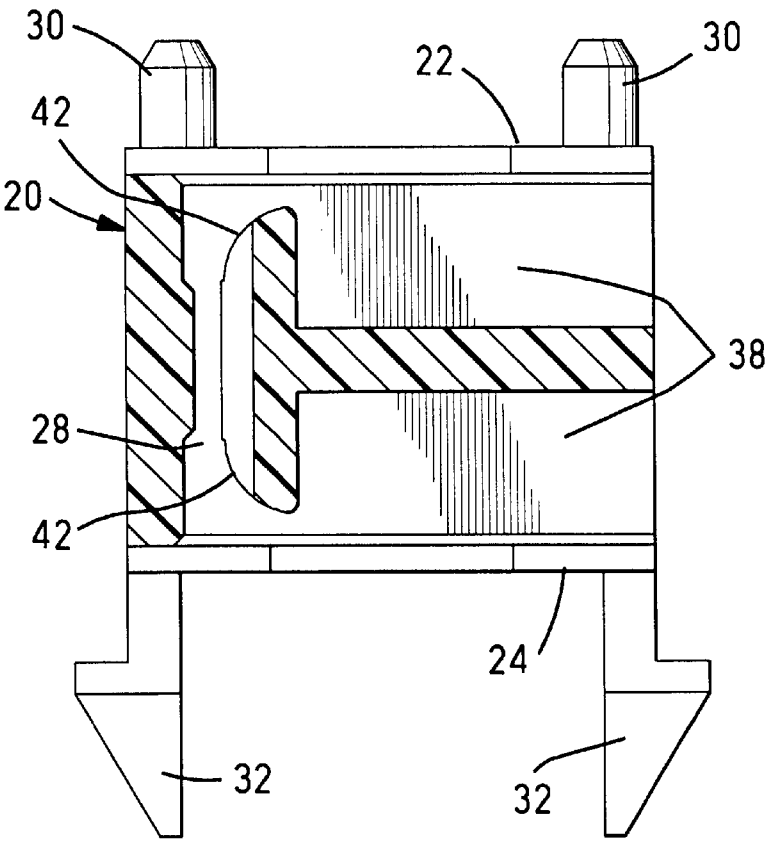
FIGS. 11 and 12 are cross-sectional views taken along lines 11—11 and 12—12 respectively of FIG. 7.
Figure 11:
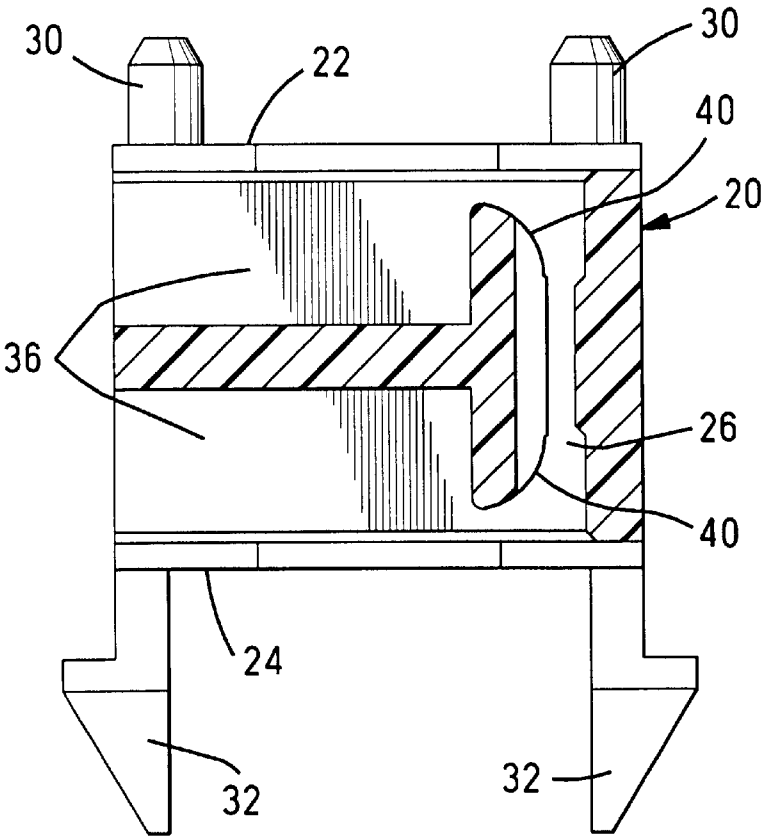

Contact projections 58*a* and 58*b*, which engage conductive pads on the circuit boards, are formed on the respective end sections of the contacts 50. Furthermore, two projections 60 and 62 are formed on the central section of each contact 50. The height of the contact projections 58*a* and 58*b* is approximately 0.08 mm, the height of the second projections 60 is approximately 0.52 mm, and the height of the first projections 62 is approximately 0.55 mm or higher than second projections 60 as may be seen in FIG. 14. As shown in FIG. 10, the cross-sectional shape of the contact press-fitting holes 26 in which the contacts 50 on which the above projections are formed are press-fitted is a T-shaped cross section which has projecting space 26*a* formed in the central portion. When the contacts 50 are press-fitted in the contact press-fitting holes 26, the contacts 50 are inserted into the contact press-fitting holes 26 from the end of the contact projections 58*a*. When each contact 50 is press-fitted in the corresponding contact press-fitting hole 26, the contact projection 58*a* faces in the opposite direction from the projecting space 26*a*, so that the contact projection 58*a* passes smoothly through the contact press-fitting hole 26. The second projection 60 enters the contact press-fitting hole 26 first, after which the first projection 62 enters the contact press-fitting hole 26. The second projection 60 proceeds smoothly through the contact press-fitting hole 26; however, since the height of the projection 62 is greater than the height of the second projection 60, the projection 62 frictionally engages the walls of the insulating housing 20 at a point slightly to the inside of the entrance of the contact press-fitting hole 26. As a result of this frictional engagement, the contact 50 stops. In this case, anchoring projections or barbs 64 formed on the contact 50 extend outwardly from opposite side edges of the central section to bite with the walls of contact press-fitting hole 26 in the insulating housing 20; as a result, the contact 50 is fastened in place in the contact press-fitting hole 26. It is shown in FIGS. 13 and 14 that a first pair of anchoring projections 64 are generally aligned with second projection 60, and a second pair of projections 64 are generally aligned with first projection 62, with the first pair of projections being spaced axially from the second pair towards the end of the contact that is inserted into the housing and therefore enter the constriction first, and with projections of the second pair being slightly longer than those of the first pair and entering the constriction last.

The contacts 50 fastened in place in the contract press-fitting holes 28 as described above, are linear in form. Then, both end sections of each contact 50 are subjected to bending with the engaging members 42 operating as supporting points, so that contact members 58, which extend along the upper and lower surfaces 22 and 24 from both ends of the central section having the projections 60 and 62, to springably engage the circuit boards, are formed. The same operation is carried out for contacts 52 when they are fastened within contact press-fitting holes 26. As shown in FIGS. 13 and 14, respective contact projections 58*a* and 58*b* are formed on these contact members 54 and 58; the contacts 50 and 52 are arranged in alternate opposing directions, these contact projections 58*a* and 58*b* are also arranged in like manner. When the electrical connector 10 is mounted on the circuit boards, the contact projections 58*a* and 58*b* thus arranged electrically engage conductive pads on the circuit boards so that the force acting between the circuit boards and the electrical connector 10 is balanced, thereby causing the electrical connector 10 to be maintained in a stable attitude and orientation. Furthermore, since contact members are formed on the contacts 50 by press-fitting the linear contacts 50 in contact press-fitting holes 28 and subjecting the contacts 50 to bending as described above, manufacture of the electrical connector is simple.

Next, the effect of the contact members will be described with reference to FIGS. 15 and 16. Here, the contact projections 58*a* on the contact 50 will be described as an example.

Figure 15:
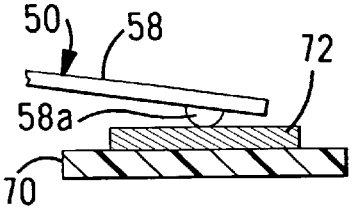
FIG. 15 is a part cross-sectional view showing a contact section in electrical engagement with a circuit pad of a circuit board.
Figure 16:
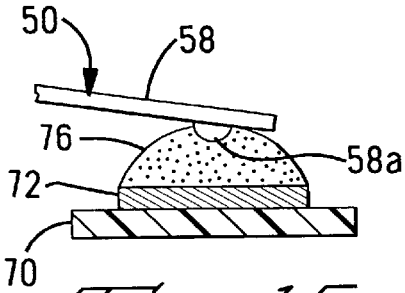
FIG. 16 is a view similar to FIG. 15 showing the contact section soldered to the circuit pad.

In cases where conductive pads 72 are formed on the circuit boards 70 as shown in FIG. 15, the contact projections 58*a* wipingly engage these conductive pads 72 with a high contact pressure; accordingly, a high electrical connection reliability is obtained. On the other hand, in cases where conductive pads 72 have flow solder or the like 76 thereon located on the circuit boards 70 as shown in FIG. 16, the areas surrounding the contact projections 58*a* on the contacts 50 engage the solder 76, so that the contact projections 58*a* do not sink into the solder 76 any further than is necessary. Accordingly, as in the case of FIG. 15, a high electrical connection reliability is obtained.

In the electrical connector of the present invention, as was described above, contacts are press-fitted in a plurality of contact press-fitting holes which are arranged in rows of an insulating housing. Accordingly, the force acting between the electrical connector and the circuit boards on which the electrical connector is mounted is balanced, so that the electrical connector is maintained in a stable attitude and orientation. Furthermore, since each of the contacts comprises a central section and contact sections which extend from the central section, contacts with this shape can be manufactured by press-fitting linear contacts in the contact press-fitting holes, and then bending the end sections of the contacts. Such linear contacts can be manufactured by punching a metal plate; accordingly, the discarded portions of the metal plate are small, so that the utilization of material is very good and economical.

Furthermore, in the method according to the present invention for manufacturing an electrical connector, an insulating housing is molded with press-fitting holes, linear contacts are formed, and these linear contacts are press-fitted in the contact press-fitting holes in the insulating housing, after which both end sections of the linear contacts are bent so that spring contact sections extend along opposed surfaces of the insulating housing. Accordingly, there is no need to manufacture contacts which have a complicated shape, and the electrical connector manufacturing process is therefore simplified.

The invention is claimed according to the following:

1. An electrical connector for disposition between mutually facing circuit boards and for electrical connection with conductive pads on the circuit boards comprises an insulating housing (20) having surfaces (22,24) for facing the respective circuit boards and holes (26,28), electrical contacts (50,52) disposed in the holes (26,28) including contact members (54,58) characterized by:

said holes (26,28) are contact press-fitting holes in which the electrical contacts (50,52) in linear form are inserted with central sections of the contacts secured inside the insulating housing and contact sections extend from the central sections beyond the respective surfaces (22,24) of the insulating housing, said contact sections being bent to extend along the respective surfaces and spaced therefrom defining spring contact members (54,58) for electrical engagement with the conductive pads on the circuit boards, and each said contact press-fitting hole (26,28) includes a constriction inwardly from entrances along said surfaces (22,24), and each said contact central section includes a first projection (62) and a second projection (60) spaced axially therefrom that cause an interference fit within said constriction.

2. An electrical connector as claimed in claim 1 wherein said contact press-fitting holes (26,28) extend from respective said surfaces in rows adjacent to respective opposing sides of said insulating housing.

3. An electrical connector as claimed in claim 2, wherein the contact press-fitting holes (26) along one said side of the insulating housing (20) are offset with respect to the contact press-fitting holes (28) along the other side of the insulating housing (20).

4. An electrical connector as claimed in claim 3, wherein the spring contact members (58) of electrical contacts (50) extend along surfaces (22, 24) in one direction whereas the spring contact members (54) of electrical contacts (52) extend along surfaces (22, 24) in an opposite direction from said one direction.

5. An electrical connector as claimed in claim 1, wherein engaging members (40, 42) are provided in said insulating housing (20) which define fulcra against which the contact sections engage for bending the contact sections so that they extend along the surfaces (22, 24) as spring contact members (54, 58).

6. An electrical connector as claimed in claim 1, wherein positioning bosses (30) and flexible legs (32) are provided on insulating housing (20) for positioning the connector on the circuit boards.

7. An electrical connector for disposition between mutually facing circuit boards and for electrical connection with conductive pads on the circuit boards, comprising:

an insulating housing having surfaces for facing the respective circuit boards and holes, electrical contacts in linear form disposed in respective said holes and including respective contact members at opposed ends thereof;

said holes being contact press-fitting holes in which said contacts are inserted with central sections of said contacts secured inside said housing and said contact sections extend from said central sections beyond respective said surfaces, said contact sections being bent to extend along and spaced from said respective surfaces defining spring contact members deflectable toward said respective surfaces upon electrical engagement with said conductive pads on said circuit boards, and each said contact press-fitting hole includes a constriction inwardly from entrances along said surfaces, and each said contact central section includes a first projection and a second projection spaced axially therefrom that cause an interference fit within said constriction.

8. An electrical connector as claimed in claim 7 wherein said contact press-fitting holes (26,28) extend from respective said surfaces in rows adjacent to respective opposing sides of said insulating housing.

9. An electrical connector as set forth in claim 8 wherein said contact press-fitting holes along one side of said housing are offset with respect to said contact press-fitting holes along an opposed side of said housing.

10. An electrical connector as set forth in claim 9 wherein said spring contact members of alternating ones of said contacts extend along said respective surfaces in opposing directions.

11. An electrical connector as set forth in claim 7 wherein engaging members are provided in said housing that define fulcra against which said contact sections engage for bending said contact sections to extend along said respective surfaces to become spring contact members.

12. An electrical connector as set forth in claim 7 wherein positioning bosses and flexible legs are provided on said housing for positioning the connector on said circuit boards.

13. An electrical connector as set forth in claim 1 wherein said constriction is T-shaped in cross-section.

14. An electrical connector as set forth in claim 13 wherein each said contact (50,52) includes a board-connecting projection **(58*a*, 58*b*) at an end of said contact section (58), and said first central section projection (62) is higher than said board-connecting projection (58*a*, 58*b*)** permitting said contact section to pass freely through said constriction during connector assembly.

15. An electrical connector as set forth in claim 14 wherein each said second projection (60) is spaced axially from said first projection (62) toward an end of said contact that is inserted into said housing (20) during assembly, and each said central section further includes barbs (64) that extend outwardly from opposing side edges thereof to penetrate adjacent wall surfaces of said housing (20) along said constriction upon insertion of said contact (50,52) in a respective said contact press-fitting hole (26,28).

16. An electrical connector as set forth in claim 15 wherein each said contact central section includes a first pair of barbs adjacent said second projection (60) and a second pair of barbs adjacent said first projection (62), and said barbs of said second pair extend outwardly farther than said barbs of said first pair.

17. An electrical connector as set forth in claim 7 wherein said constriction is T-shaped in cross-section.

18. An electrical connector as set forth in claim 17 wherein each said contact includes a board-connecting projection at an end of said contact section, and said first central section projection is higher than said board-connecting projection permitting said contact section to pass freely through said constriction during connector assembly.

19. An electrical connector as set forth in claim 18 wherein each said second projection is spaced axially from said first projection toward an end of said contact that is inserted into said housing during assembly, and each said central section further includes barbs that extend outwardly from side edges thereof to penetrate adjacent wall surfaces of said housing along said constriction upon insertion of said contact in a respective said contact press-fitting hole.

20. An electrical connector as set forth in claim 19 wherein each said contact central section includes a first pair of barbs adjacent said second projection and a second pair of barbs adjacent said first projection, and said barbs of said second pair extend outwardly farther than said barbs of said first pair.

* * * * *